US005284729A

United States Patent [19]

Tanaka et al.

[11] Patent Number: 5,284,729

[45] Date of Patent: Feb. 8, 1994

[54] COATING COMPOSITION FOR ELECTROPHOTOGRAPHIC PHOTOSENSITIVE MEMBER AND METHOD FOR FORMING ELECTROPHOTOGRAPHIC PHOTOSENSITIVE COATING FILM BY USE THEREOF

[75] Inventors: Shigemori Tanaka, Tokyo; Takashi Tanaka, Kawasaki, both of Japan

[73] Assignee: Canon Kabushiki Kaisha, Tokyo, Japan

[21] Appl. No.: 549,124

[22] Filed: Jul. 6, 1990

[30] Foreign Application Priority Data

Jul. 14, 1989 [JP] Japan ..... 1-180229

[51] Int. Cl.[5] ..... G03G 5/14

[52] U.S. Cl. ..... 430/66; 430/67

[58] Field of Search ..... 430/66, 67

[56] References Cited

U.S. PATENT DOCUMENTS

| | | | |
|---|---|---|---|
| 4,362,799 | 12/1982 | Kondo et al. | 430/66 |
| 4,571,371 | 2/1986 | Yashiki | 430/62 |
| 4,759,991 | 7/1988 | Kamo et al. | 428/447 |
| 4,962,008 | 10/1990 | Kimura et al. | 430/66 |

*Primary Examiner*—Marion E. McCamish
*Assistant Examiner*—S. Rosasco
*Attorney, Agent, or Firm*—Fitzpatrick, Cella, Harper & Scinto

[57] ABSTRACT

A coating composition for an electrophotographic photosensitive member contains a volatile levelling agent. A method for forming a coating film of an electrophotographic photosensitive member, comprises applying a coating composition for the electrophotographic photosensitive member, the coating composition containing a volatile levelling agent, and drying the coating composition by heating with volatilization of the levelling agent to form a coating film.

19 Claims, No Drawings

COATING COMPOSITION FOR ELECTROPHOTOGRAPHIC PHOTOSENSITIVE MEMBER AND METHOD FOR FORMING ELECTROPHOTOGRAPHIC PHOTOSENSITIVE COATING FILM BY USE THEREOF

BACKGROUND OF THE INVENTION

Field of the Invention

The present invention relates to a coating composition containing a volatile levelling agent for an electrophotographic photosensitive member, and also relates to a method for forming a coating film of an electrophotographic photosensitive member.

Related Background Art

Conventionally, photosensitive layers of electrophotographic photosensitive members are classified into two types: a coating type and a vapor-deposition type, according to the formation processes. For photosensitive layers of electrophotographic photosensitive members, a variety of organic compounds have been comprehensively studied for a material which is low in cost, non-polluting, and easily synthesizable. Most of the photosensitive layers containing an organic compound for the electrophotographic photosensitive members are of a coating type. The coating compositions for the photosensitive layers are usually made from an organic compound, such as an organic photoconductive substance, dispersed in a binder resin. In producing electrophotographic photosensitive members by using such a coating composition for photosensitive layers, the solvent in the coating composition is usually removed by heat-drying after application of the coating composition. Heat drying is not confined to photosensitive layers but is employed in electroconductive layers and subbing layers optionally formed between a photosensitive layer and an electroconductive support, as well as surface-protecting layers.

The coating of a photosensitive layer is conducted by Meyer bar coating, blade coating, knife coating, roll coating, screen coating, dip coating, spray coating, beam coating, and the like.

Coated films formed by such a coating method may have defects such as orange peel, pinholes, and bubbles. In particular, coating compositions of a pigment dispersion type are liable to have surface defects such as color breakup, lifting, cratering, and the like, which causes unevenness, white-dots and black-dots of images. Such defect formation is known to be avoided by adding to the coating composition, in a very small amount, a levelling agent such as an anionic, cationic, or nonionic surfactant, a fluorinated polyolefin, a polyvinylbutyral, a polyacrylate, a silicone oil, and the like.

On the other hand, some substances which are used for a coating composition for electrophotographic photosensitive member are not heat-resistant, and may be deteriorated by heat on prolonged drying at a high temperature to affect adversely the electrophotographic characteristics. Accordingly, the drying is conducted usually at a temperature of not higher than 200° C. for about one hour in most cases. Under such drying conditions, a polymeric silicone oil of average molecular weight of 10,000 to 100,000, for example, cannot be removed but remains in the coating film. Since an electrophotographic photosensitive member serves to form an image by utilizing transport of carriers generated by action of light through a photosensitive layer, the presence of an obstacle to the movement of the carriers, such as an electric barrier and a trap, impairs electrophotographic characteristics, causing, for example, decrease of memory, rise of residual potential, deterioration in durability, etc.

Hence, even though a coated film having no surface defect is obtained by use of a coating-levelling agent, the levelling agent remaining in the coated film may impair the electrophotographic characteristics, so that levelling agents are greatly limited in the kind and the amount to be used.

SUMMARY OF THE INVENTION

An object of the present invention is to provide a coating composition for an electrophotographic photosensitive member which has a smooth coating film, and has satisfactory electrophotographic characteristics even after repeated use.

Another object of the present invention is to provide a method for forming a coating film for an electrophotographic photosensitive member by using the aforementioned coating composition.

According to an aspect of the present invention, there is provided a coating composition for an electrophotographic photosensitive member containing a volatile levelling agent.

According to another aspect of the present invention, there is provided a method for forming a coating film of an electrophotographic photosensitive member, comprising applying a coating composition containing a volatile levelling agent for the electrophotographic photosensitive member, and drying the coating composition by heating with volatilization of the levelling agent to form a coating film.

DETAILED DESCRIPTION OF THE PREFERRED EMBODIMENT

The levelling agent of the present invention, even if used in a large amount in formation of a coating film, volatilizes off completely, or is removed to such an extent that deterioration of the electrophotographic characteristics, such as rise of residual potential, is not caused. Moreover, the levelling agent serves to lower the surface tension during evaporation of the solvent from the coating composition and to retard convection in the coating composition, thereby giving uniform coating film without surface defect.

The volatile levelling agent employed in the present invention has preferably a boiling point of not higher than 300° C., and a weight-average molecular weight of not higher than 1,000, preferably not higher than 600.

The levelling agent employed in the present invention is preferably a silicone oil having a siloxane structure, and more preferably a silicone oil having a structure represented by the general formula (I) or (II):

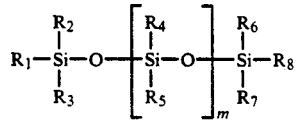

(I)

-continued (II)

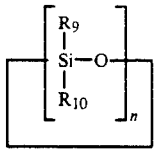

where $R_1$ to $R_{10}$ are respectively an alkyl group such as methyl, ethyl, and the like, an aryl group such as phenyl, and the like, or an alkoxy group such as methoxy, ethoxy, and the like, which may be substituted by other substituent, a halogen atom or the like; and m and n are respectively an integer.

Among these, particularly preferable are those in which $R_1$-$R_{10}$ groups are selected from methyl, ethyl, methoxy, and ethoxy, and m is an integer of 2–4, and n is an integer of 4–6.

Volatile silicone oils employed in the present invention are specifically exemplified below:

Exemplified compound (1):

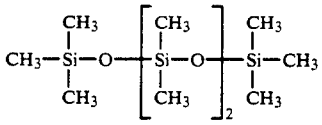

Boiling point: 194° C.
Molecular weight: 310

Exemplified compound (2):

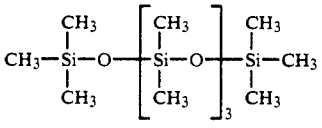

Boiling point: 229° C.
Molecular weight: 384

Exemplified compound (3):

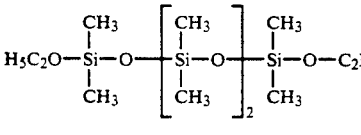

Boiling point: 227° C.
Molecular weight: 370

Exemplified compound (4):

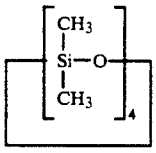

Boiling point: 171° C.
Molecular weight: 296

Exemplified compound (5):

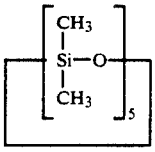

Boiling point: 204° C.
Molecular weight: 370

Exemplified compound (6):

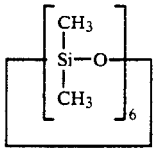

Boiling point: 245° C.
Molecular weight: 444

The higher the molecular weight of the levelling agent is, the stronger is the levelling effect exhibited, and the smaller the volatility is correspondingly.

In this respect, cyclic silicone oil represented by the general formula (II) is advantageous because of the higher volatility for the molecular weight.

The volatile levelling agents employed in the present invention, even if the molecular weights thereof are low, exhibit sufficient levelling effect when added in a sufficient quantity.

The volatile levelling agents employed in the present invention are effective for any coating composition for an electrophotographic photosensitive member, and particularly effective for a pigment dispersion type of coating compositions for electrophotographic photosensitive member such as coating compositions for a charge generation layer and coating compositions for an electroconducting layer.

The levelling agent of the present invention may be added to the coating composition either in coating composition formulation step, or after completion of the coating composition formulation similarly to usual levelling agents.

The amount of the volatile levelling agent to be added to the coating composition for the electrophotographic photosensitive member is preferably in the range of from 0.05 to 3% by weight, more preferably from 0.1 to 1% by weight based on the coating-film-forming material for the electrophotographic photosensitive member.

The heat-drying of the coating composition for the electrophotographic photosensitive member of the present invention is conducted preferably at a temperature of not higher than 200° C. and for a time of not longer than 1 hour, more preferably in the range of temperature of from 50° to 150° C. and for a time of from 5 minutes to 1 hour.

The electrophotographic photosensitive member produced by using the coating composition for electrophotographic photosensitive members of the present invention is described below.

The applicable electroconductive supports include aluminum, brass, stainless steel, and the like formed into a cylinder or a foil; and paper and plastics having been vapor-deposited or laminated with aluminum, tin oxide, antimony oxide, indium oxide, and the like.

An electroconductive layer is sometimes provided on the electroconductive support in order to cover a scratch or a defect or to inhibit injection of carriers from the support. The electroconductive layer may be formed by application of a coating composition for electroconductive layers which has been prepared by dispersing an electroconductive material such as metal powder of aluminum, silver, gold, nickel, copper, etc., powdery carbon, tin oxide, antimony oxide, and indium oxide, and the like in a resin such as a phenol resin, a polyurethane, an epoxy resin, an alkyd resin, and the like in a suitable solvent; and subsequently drying it by heating. The thickness of the electroconductive layer is preferably in the range of from 10 to 50 μm, more preferably from 15 to 40 μm.

Between the electroconductive support or electroconductive layer and the photoconductive layer, there may be formed a subbing layer having a barrier function and an adhesive function.

The subbing layer may be formed by application of a coating composition for subbing layer which has been prepared by dissolving casein, polyvinylalcohol, nitrocellulose, ethylene-acrylate copolymer, polyamide (such as nylon 6, nylon 66, nylon 610, copolymer nylon, alkoxymethylated nylon, etc.), polyurethane, and the like in a suitable solvent; and subsequent drying thereof by heating.

The thickness of the subbing layer is preferably in the range of from 0.1 to 5 μm, more preferably from 0.3 to 3 μm.

The subbing layer has preferably a resistivity of not less than $10^7$ Ωcm in order to fulfill its function.

The photosensitive layer may be formed by application of a coating composition for photosensitive layers, and subsequent drying thereof by heating.

The photosensitive layer may be either of a lamination type constituted of a charge generation layer and a charge transport layer, or of a monolayer type.

In the lamination type of photosensitive layer, the charge generation layer may be formed by application of a coating composition for charge generation layer which has been prepared by dispersing a charge-generating substance such as an azo pigment like Sudan Red, Dian Blue, Jenus Green B, etc., a quinone pigment like Algol Yellow, Pyrene Quinone, Indanthrene Brilliant Violet RRP, etc., a quinocyanine pigment, a perylene pigment, an indigo pigment like indigo, thioindigo, etc., a bisbenzoimidazole pigment like Indian Fast Orange Toner, etc. a phthalocyanine pigment like copper phthalocyanine, etc., a quinacridone pigment, and the like, in a binder resin such as a polycarbonate, a polyester, a polystyrene, a polyvinylbutyral, a polyamide, an acrylic resin, a polyacrylate, a polyvinylpyrrolidone, a methylcellulose, a polyacrylic ester, a cellulose ester resin, and the like in a suitable solvent; and subsequent drying thereof by heating. The film thickness of the charge generation layer is preferably in the range of from 0.01 to 1 μm, more preferably from 0.05 to 0.5 μm.

The charge transport layer in the lamination type may be formed by application of a coating composition for charge transport layers which has been prepared by dispersing a charge-transporting substance such as a hydrazone compound, a pyrazoline compound, a styryl compound, a carbazole compound, a triarylamine compound and the like in a binder resin mentioned below in a suitable solvent; and by subsequent drying thereof by heating.

The binder resin includes a polycarbonate, a polymethacrylic ester, a polyamide, a polyarylate, a polystyrene, a polyester, a polysulfone, a styrene-acrylonitrile copolymer, a styrene-methyl methacrylate copolymer, and the like. The thickness of the charge-transport layer is preferably in the range of from 5 to 30 μm, more preferably from 10 to 20 μm.

The monolayer type of the photosensitive layer may be formed by application of a coating composition for photosensitive monolayers which has been prepared by dispersing a charge-generating substance and a charge-transporting substance in a aforementioned binder resin in a suitable solvent, and by subsequent drying thereof by heating.

Since coloring matters, pigments, organic charge-transporting substances, etc. are less resistant to ultraviolet light, ozone, staining with oil, metal cuttings, and so on, a protection layer may be formed, if necessary. The protection layer has preferably a surface resistivity of $10^{11}$ Ωcm or more in order to form an electrostatic latent image thereon.

The protection layer may be formed by application of a coating composition for protection layers which has been prepared by dissolving a resin such as a polyvinylbutyral, a polyester, a polycarbonate, an acrylic resin, a methacrylic resin, a nylon, a polyimide, a polyarylate, a polyurethane, a styrene-butadiene copolymer, a styrene-acrylate copolymer, a styrene-acrylonitrile copolymer, and the like in a suitable solvent, and by subsequent drying thereof by heating. The thickness is suitably decided within the range of from 0.05 to 20 μm. The protective layer may contain an electroconductive particulate matter, a UV absorber, or the like.

In the surface-protection layer, or onto the surface of the photosensitive layer which does not have a surface-protection layer, there may be dispersed a solid lubricant such as a powdery fluoro-resin including PTFE, PFA, PVDF, etc., and $MoS_2$, $WS_2$, BN, etc. for the purpose of imparting lubricity to the surface of the photosensitive layer, or there may be dispersed $Al_2O_3$, $TiO_2$, $SiO_2$ or the like for the purpose of imparting coating strength.

The electroconductive layer or a charge generation layer may also be formed by vapor-deposition.

The solvents applicable to the coating compositions for electrophotographic photosensitive members include alcohols such as methanol, ethanol, isopropanol, etc.; ketones such as acetone, methyl ethyl ketone, cyclohexanone etc.; amides such as N,N-dimethylformamide, N,N-dimethylacetamide, etc.; sulfoxides such as dimethylsulfoxide, etc.; ethers such as tetrahydrofuran, dioxane, ethylene glycol monomethyl ether, etc.; esters such as methyl acetate, ethyl acetate, etc.; aliphatic halogenated hydrocarbons such as chloroform, methylene chloride, dichloroethylene, carbon tetrachloride, trichloroethylene, etc.; aromatic compounds such as benzene, toluene, xylene, ligroin, chlorobenzene, dichlorobenzene, etc., and the like.

The method of application of the coating composition for electrophotographic photosensitive members is not specially limited.

The applied coating composition may initially be dried to touch at a room temperature and subsequently dried by heating.

EXAMPLE 1

110 parts (hereinafter parts are based on weight) of titanium oxide having the surface treated with alumina, 110 parts of titanium oxide having the surface treated with $Sb_2O_3$, 100 parts (as solid matter) of a phenol resin, 68 parts of methanol, 68 parts of methylcellosolve, and 0.32 part of the cyclic silicone oil of Exemplified compound (4) (having a molecular weight of 296) as the volatile levelling agent were dispersed by means of a sand mill for 2 hours to prepare an electroconductive coating composition. The coating composition is diluted with methanol and methylcellosolve to give a viscosity of 150 cps.

Subsequently, the coating composition is applied onto the surface of an aluminum cylinder of 80 mm diameter and 360 mm long by dip coating, and dried by heating at 140° C. for 30 minutes to prepare an electroconductive layer of 20 μm thick.

On the electroconductive layer, a coating solution which had been prepared by dissolving 10 parts of a polyamide (a copolymer nylon) in a mixed solvent composed of 60 parts of methanol and 40 parts of butanol was applied by dip coating to form a subbing layer of 1 μm thick.

Separately, 10 parts of disazo pigment represented by the formula below,

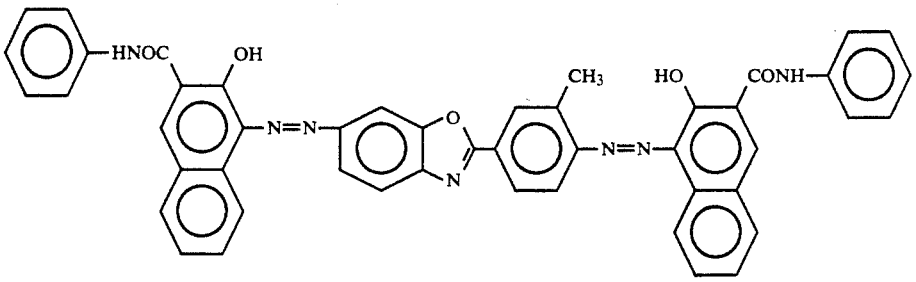

6 parts of a cellulose acetate butyrate resin, and 60 parts of cyclohexanone were dispersed by means of a sand mill employing glass beads of 1 mm diameter for 20 hours.

To this liquid dispersion, 100 parts of methyl ethyl ketone was added, and the mixture was applied on the aforementioned subbing layer by dip coating, and dried by heating at 100° C. for 10 minutes to form a charge-generation layer of 0.1 μm thick.

Subsequently, 10 parts of a hydrazone compound of the structural formula below,

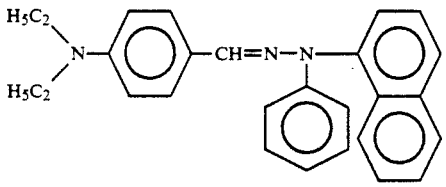

and 15 parts of a polymethyl methacrylate were dissolved in 80 parts of dichloromethane. The solution was applied on the above-mentioned charge-generation layer, and subjected to hot-air drying at 100° C. for 1 hour to form a charge transport layer of 20 μm thick, thus preparing an electrophotographic photosensitive member, which is referred to as "Photosensitive member 1".

COMPARATIVE EXAMPLE 1

An electrophotographic photosensitive member was prepared in the same manner as in Example 1 except that 0.03 part of a silicone oil (a linear polymethylsiloxane) having an average molecular weight of 10,000 was used in place of the Exemplified compound (4) used in the coating composition for the electroconductive layer. The resulting member is referred to as "Photosensitive member 2".

The silicone oil used here is non-volatile in the step of the heat-drying of the coating composition.

EXAMPLE 2

An electrophotographic photosensitive member was prepared from the same materials and in the same manner as Example 1 except that the coating was conducted by spray coating.

The resulting member is referred to as "Photosensitive member 3".

COMPARATIVE EXAMPLE 2

An electrophotographic photosensitive member was prepared from the same materials and in the same manner as in Comparative example 1 except that coating was conducted by spray coating.

The resulting member is referred to as "Photosensitive member 4".

Photosensitive members 1 to 4 were subjected to durability tests of 50,000-sheet copying by using a copying machine (NP3525, made by Canon K.K.) with measurement of electrophotographic characteristics being made. The results are shown below. "$V_D$" means a dark-portion potential and "$V_L$" means a light-portion potential.

| Photosensitive member | $V_D$ (−V) | $V_L$ (−V) | Fogging of image | Rise of $V_L$ (V) |
|---|---|---|---|---|
| | Initial values | | | |
| 1 | 640 | 180 | no fogging | |
| 2 | 660 | 170 | no fogging | |
| 3 | 650 | 180 | no fogging | |
| 4 | 640 | 180 | no fogging | |
| | Values after 50,000 sheet copying | | | |
| 1 | 590 | 200 | no fogging | 20 |
| 2 | 610 | 250 | fogging | 80 |
| 3 | 600 | 210 | no fogging | 30 |
| 4 | 580 | 280 | fogging | 100 |

EXAMPLE 3

An electrophotographic photosensitive member was prepared in the same manner as in Example 1 except that 0.32 part of Exemplified compound (5) having a molecular weight of 370, another volatile levelling agent, was used in place of Exemplified compound (4) used in the coating composition for the electroconductive layer. The resulting member is referred to as "Photosensitive member 5".

EXAMPLE 4

An electrophotographic photosensitive member was prepared in the same manner as in Example 1 except that 0.32 part of the Exemplified compound (2) having a molecular weight of 384, another volatile levelling agent, was used in place of Exemplified compound (4) used in the coating composition for the electroconductive layer. The resulting member is referred to as "Photosensitive member 6".

EXAMPLE 5

Layers were formed to a charge generation layer in the same manner as in Example 1. Subsequently, 10 parts of the hydrazone compound of the structural formula below,

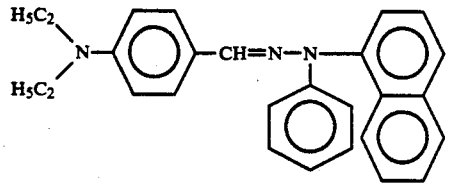

15 parts of polymethyl methacrylate, 2 parts of a powdery tetrafluoroethylene resin (PTEF), and 0.05 part of the Exemplified compound (6) having a molecular weight of 444 as the volatile levelling agent were mixed in 60 parts of chlorobenzene for 4 hours by means of a sand mill using glass beads of 1 mm diameter to prepare a coating composition having PTEF dispersed therein. The coating composition was applied on the aforementioned charge generation layer by dip coating, and was dried with hot air at 100 ° C. for one hour to form a charge-transport layer of 20 μm thick, thus producing an electrophotographic photosensitive member. The resulting member is referred to as "Photosensitive member 7".

COMPARATIVE EXAMPLE 3

An electrophotographic photosensitive member was prepared in the same manner as in Example 5 except that 0.01 part of a silicone oil (a modified polymethylsiloxane) having an average molecular weight of 10,000 was used in place of Exemplified compound (6) used as a volatile levelling agent. The resulting member is referred to as "Photosensitive member 8".

The silicone oil used here is non-volatile in the step of heat-drying of the coating composition.

Photosensitive members 5 to 8 were evaluated in the same manner as in Photosensitive members 1 to 4. The results are as follows.

| Photosensitive member | $V_D$ (−V) | $V_L$ (−V) | Fogging of image | Rise of $V_L$ (V) |
|---|---|---|---|---|
| | Initial values | | | |
| 5 | 650 | 170 | no fogging | |
| 6 | 630 | 160 | no fogging | |
| 7 | 670 | 210 | no fogging | |
| 8 | 690 | 250 | fogging | |
| | Values after 50,000 sheet copying | | | |
| 5 | 580 | 200 | no fogging | 30 |
| 6 | 590 | 200 | no fogging | 40 |
| 7 | 630 | 240 | no fogging | 30 |
| 8 | 720 | 450 | fogging | 200 |

EXAMPLE 6

An electrophotographic photosensitive member was prepared in the same manner as in Example 1 except that the amounts of solvents were respectively doubled and coating was conducted by beam coating. The resulting member is referred to as "Photosensitive member 9".

COMPARATIVE EXAMPLE 4

An electrophotographic photosensitive member was prepared in the same manner as in Comparative example 1 except that the amounts of solvents were respectively doubled and coating was conducted by beam coating. The resulting member is referred to as "Photosensitive member 10".

The Photosensitive members 9 and 10 were evaluated in the same manner as in Photosensitive members 1 to 4. The results are as follows.

| Photosensitive member | $V_D$ (−V) | $V_L$ (−V) | Fogging of image | Rise of $V_L$ (V) |
|---|---|---|---|---|
| | Initial values | | | |
| 9 | 660 | 150 | no fogging | |
| 10 | 680 | 260 | fogging | |
| | Values after 50,000 sheet copying | | | |
| 9 | 610 | 180 | no fogging | 30 |
| 10 | 630 | 470 | fogging | 210 |

What is claimed is:

1. A coating composition for forming a coating film of an electrophotographic photosensitive member containing as a volatile, removable levelling agent a silicone oil having the general formula:

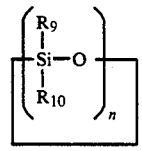

wherein $R_9$ and $R_{10}$ are each a substituted or unsubstituted alkyl group, a substituted or unsubstituted aryl group, or a substituted or unsubstituted alkoxy group, and n is an integer, said volatile levelling agent being removed at least to an extent sufficient to prevent deterioration of electrophotographic characteristics of said coating film prior to formation of said coating film.

2. The coating composition for an electrophotographic photosensitive member of claim 1, wherein the volatile levelling agent has a boiling point of not higher than 300° C.

3. The coating composition for an electrophotographic photosensitive member of claim 1, wherein the volatile levelling agent has an average molecular weight of not higher than 1,000.

4. The coating composition for an electrophotographic photosensitive member of claim 1, wherein the volatile levelling agent has an average molecular weight of not higher than 600.

5. The coating composition for an electrophotographic photosensitive member of claim 1, wherein $R_9$, and $R_{10}$ are each independently selected from the group consisting of methyl, ethyl, methoxy, and ethoxy.

6. The coating composition for an electrophotographic photosensitive member of claim 1, wherein n is an integer of 4, 5, or 6.

7. The coating composition for an electrophotographic photosensitive member of claim 1, wherein the silicone oil is represented by the formula (III) below:

(III)

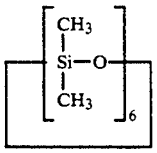

8. A method for forming a coating film of an electrophotographic photosensitive member comprising applying a coating composition for the electrophotographic photosensitive member, the coating composition containing a volatile levelling agent, and drying the coating composition by heating with volatilization of the levelling agent to remove said volatile levelling agent at least to an extent sufficient to prevent deterioration of electrophotographic characteristics of said coating film and to thereby form a coating film.

9. The method for forming a coating film of an electrophotographic photosensitive member of claim 8, wherein the coating composition is applied by dip coating.

10. The method for forming a coating film of an electrophotographic photosensitive member of claim 8, wherein the coating composition is applied by beam coating.

11. The method for forming a coating film of an electrophotographic photosensitive member of claim 8, wherein the volatile levelling agent has a boiling point of not higher than 300° C.

12. The method for forming a coating film of an electrophotographic photosensitive member of claim 8, wherein the volatile levelling agent has an average molecular weight of not higher than 1,000.

13. The method for forming a coating film of an electrophotographic photosensitive member of claim 8, wherein the volatile levelling agent has an average molecular weight of not higher than 600.

14. The method for forming a coating film of an electrophotographic photosensitive member of claim 8, wherein the volatile levelling agent is a silicone oil having a siloxane structure.

15. The method for forming a coating film of an electrophotographic photosensitive member of claim 14, wherein the silicone oil is represented by the general formula (I) or (II) below:

(I)

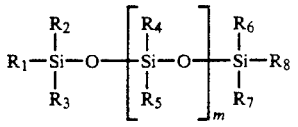

(II)

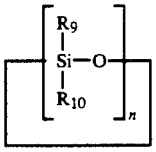

wherein $R_1$, $R_2$, $R_3$, $R_4$, $R_5$, $R_6$, $R_7$, $R_8$, $R_9$, and $R_{10}$, are each a substituted or unsubstituted alkyl group, a substituted or unsubstituted aryl group, or a substituted or unsubstituted alkoxy group, and m and n are each an integer.

16. The method for forming a coating film of an electrophotographic photosensitive member of claim 15, wherein $R_1$, $R_2$, $R_3$, $R_4$, $R_5$, $R_6$, $R_7$, $R_8$, $R_9$, and $R_{10}$ are each independently selected from the group consisting of methyl, ethyl, methoxy, and ethoxy.

17. The method for forming a coating film of an electrophotographic photosensitive member of claim 15, wherein m is an integer of 2, 3, or 4.

18. The method for forming a coating film of an electrophotographic photosensitive member of claim 15, wherein n is an integer of 4, 5, or 6.

19. The method for forming a coating film of an electrophotographic photosensitive member of claim 15, wherein the silicone oil comprises a compound represented by the formula (III) below:

(III)

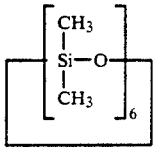

* * * * *